US008516830B2

(12) United States Patent
Duval et al.

(10) Patent No.: US 8,516,830 B2
(45) Date of Patent: Aug. 27, 2013

(54) TURBOMACHINE COMBUSTION CHAMBER

(75) Inventors: Sylvain Duval, Tournan en Brie (FR); Didier Hippolyte Hernandez, Quiers (FR); Romain Nicolas Lunel, Montereau sur le Jard (FR)

(73) Assignee: SNECMA, Paris (FR)

( * ) Notice: Subject to any disclaimer, the term of this patent is extended or adjusted under 35 U.S.C. 154(b) by 1042 days.

(21) Appl. No.: 12/544,423

(22) Filed: Aug. 20, 2009

(65) Prior Publication Data

US 2010/0058765 A1 Mar. 11, 2010

(30) Foreign Application Priority Data

Sep. 9, 2008 (FR) ..... 08 04952

(51) Int. Cl.
*F02C 7/22* (2006.01)
*F23R 3/00* (2006.01)

(52) U.S. Cl.
USPC ..... 60/798; 60/740

(58) Field of Classification Search
USPC ..... 60/798, 737, 740, 748; 277/632
See application file for complete search history.

(56) References Cited

U.S. PATENT DOCUMENTS

| | | | | |
|---|---|---|---|---|
| 3,398,529 | A * | 8/1968 | Schmitz et al. | 60/796 |
| 4,441,323 | A * | 4/1984 | Colley | 60/800 |
| 4,454,711 | A * | 6/1984 | Ben-Porat | 60/800 |
| 4,466,240 | A * | 8/1984 | Miller | 60/796 |
| 4,986,168 | A * | 1/1991 | Geffroy et al. | 277/486 |
| 5,465,571 | A * | 11/1995 | Clark | 60/800 |
| 6,354,085 | B1 | 3/2002 | Howell et al. | |
| 7,356,994 | B2 * | 4/2008 | Bleeker | 60/798 |
| 2007/0084217 | A1 * | 4/2007 | Nicholls | 60/796 |
| 2008/0105237 | A1 * | 5/2008 | Gandza | 123/470 |

FOREIGN PATENT DOCUMENTS

| | | |
|---|---|---|
| FR | 1 488 824 | 7/1967 |
| GB | 2 097 112 A | 10/1982 |

* cited by examiner

*Primary Examiner* — Ted Kim
(74) *Attorney, Agent, or Firm* — Oblon, Spivak, McClelland, Maier & Neustadt, L.L.P.

(57) ABSTRACT

A turbomachine combustion chamber including a substantially L-shaped fuel injector and a device for mounting and fastening the injector in an orifice of the casing of the chamber, is disclosed. The device includes an outer collar carried by the injector and a removable annular spacer surrounding the injector and designed to be interposed between the collar of the injector and the casing.

15 Claims, 5 Drawing Sheets

TURBOMACHINE COMBUSTION CHAMBER

FIELD OF THE INVENTION

The present invention relates to fuel injectors for a turbomachine combustion chamber, and to a method of mounting and dismantling injectors.

BACKGROUND OF THE INVENTION

A turbomachine combustion chamber comprises two walls forming bodies of revolution that are situated one inside the other and that are interconnected at their upstream ends by an annular chamber end wall. The chamber end wall has a plurality of openings distributed around the longitudinal axis of the chamber with a mixture of air and fuel being injected therethrough.

The chamber is surrounded by an outer annular casing having radial orifices for mounting fuel injectors in the chamber, each of these orifices being formed in an outer boss of the casing.

Each fuel injector is substantially L-shaped and has an arm extending substantially radially through one of the orifices of the casing and a head that extends substantially axially downstream from the radially-inner end of the arm. The radially-outer end of the arm, situated outside the casing, is connected to fuel feeder means.

The downstream end of the injector head is engaged in a mixer mounted in one of the above-mentioned openings in the chamber end wall. The arm of the injector has an outer collar that presents orifices for passing screws for fastening the injector on the boss of the casing.

In the prior art technique, when the injector head is engaged in the mixer, the collar of the injector arm bears against the boss of the casing. Operations of mounting and dismantling an injector comprise in particular a step that consists in moving the injector in translation (through a distance L) parallel to the axis of its head, in an upstream direction so as to disengage it from the mixer or in a downstream direction so as to engage it in the mixer. In one prior art embodiment, the injector is movable from a set-back position to an advanced position through a distance L of 9.17 millimeters (mm) in order to enable the injector to be dismantled. Nevertheless, this distance L is very penalizing since it increases the overall axial size of the engine, and thus its length, which leads to an increase in the weight of the engine, where such an increase is always harmful in aviation.

When the turbomachine includes an axial-centrifugal compressor, the diffuser that is arranged between the compressor and the chamber, inside the outer casing, can impede moving injectors in the upstream direction for dismantling purposes. In practice, it is necessary, for example, to leave clearance of 3.8 mm between the downstream end of the diffuser and the injector when the injector is in its furthest-back position (i.e. when it is situated furthest upstream), so as to enable the injector to be removed completely.

OBJECT AND SUMMARY OF THE INVENTION

A particular object of the present invention is to provide a solution to this problem of the present technique, which solution is simple, effective, and inexpensive.

To this end, the invention provides a turbomachine combustion chamber comprising at least one substantially L-shaped fuel injector comprising an arm with one end connected to an injection head and its other end designed to be connected to fuel feed means, and means for mounting and fastening the injector in an orifice of a casing of the chamber, said means including an outer collar carried by the arm of the injector, wherein the means for mounting and fastening the injector further comprise an annular spacer surrounding the arm of the injector and interposed between the collar of said arm and the casing, said spacer being sectorized and removable during dismantling of the means for fastening the injector on the casing so as to enable the injector to pivot in the orifice in the casing.

The annular spacer of the invention is interposed between the collar of the injector arm and the boss of the casing when the injector head is engaged in the mixer of the chamber, in such a manner that in this position the collar no longer bears directly against the boss, but on the contrary is spaced apart from the boss by a sufficient distance D. The spacer is removable and can be withdrawn from the injector before it is disengaged from the mixer. The above-mentioned distance D between the collar and the boss gives the injector a degree of freedom to move in rotation when the spacer is withdrawn from the injector, thereby enabling the head of the injector to be disengaged from the mixer by causing the injector to pivot in the orifice of the casing. During such pivoting, the outer end of the arm of the injector is moved downstream and the head of the injector is moved upstream through a distance that is sufficient to become disengaged from the mixer. This operation is performed from outside the outer casing of the chamber.

In an embodiment of the invention, it has been found that the clearance between the downstream end of the diffuser and the injector, when the injector is in its furthest-back position, is about 7.4 mm. The degree of freedom to move in rotation imparted to the injector makes it possible to limit the extent to which it is withdrawn in translation in an upstream direction while it is being dismantled. If it is considered that clearance of 3.8 mm is sufficient and necessary between these two elements to enable the injector to be removed completely (as in the prior art), then the length of the turbomachine can be shortened by (7.4 mm−3.8 mm)=3.6 mm, thereby leading to a relatively large saving in weight and thus to better performance for the turbomachine.

In an embodiment of the invention, the spacer is made up of at least two sectors placed end to end, thereby making it possible in particular to facilitate dismantling and removal of the spacer from the injector.

Each spacer sector may include at one of its circumferential ends a projecting portion that is designed to engage in a recessed portion of complementary shape provided at a circumferential end of another sector so as to make the spacer easier to mount and to keep together while the injector is being fastened.

The projecting portion from each spacer sector may for example be substantially pyramid-shaped so that said portion presents inclined faces that come to bear against inclined faces of the corresponding recessed portion, thereby improving the sealing of the assembly.

Advantageously, the means for mounting and fastening the injector comprise a clamping collar surrounding the spacer sectors in order to hold them together.

The means for mounting and fastening the injector may include at least one annular sealing gasket designed to be interposed between the collar of the arm and the spacer, between said collar and the casing, and/or between the spacer and the casing.

The spacer may present a section of shape that is substantially rectangular, triangular, T-shaped, or arbitrary. It may also include a spherical or frustoconical annular surface for bearing against the casing of the chamber.

The collar may include screw-fastening orifices to enable the injector to be fastened to the chamber casing and to enable the spacer to be clamped between the collar and the casing.

In a variant, the means for mounting and fastening the injector comprise a removable annular clamp surrounding the arm of the injector and including screw-passing orifices for fastening the injector on the casing of the chamber and for clamping the collar of the arm and the spacer between the clamp and the casing. The means for mounting and fastening the injector may include at least one annular sealing gasket interposed between the clamp and the collar and/or between the clamp and the casing.

The combustion chamber of the invention also includes an annular casing having a plurality of substantially radial orifices, each having a fuel injector mounted therein, each orifice being formed in an outer boss of the casing, the above-mentioned spacer being interposed between the collar of the injector arm and said boss.

Finally, the invention provides a method of mounting and/or dismantling a fuel injector in a combustion chamber of the above-described type, wherein the method comprises the steps consisting in removing the spacer and then in moving the injector to pivot about a transverse axis so that its head engages/disengages in/from a mixer of the chamber. Withdrawal of the spacer may be preceded by moving the injector outwards a little so as to facilitate access to the spacer. Pivoting the injector makes it possible to limit the extent to which it is moved axially in the upstream direction, thereby enabling the axial size of the engine to be reduced correspondingly so as to reduce its weight.

BRIEF DESCRIPTION OF THE DRAWINGS

The invention can be better understood and other characteristics, details, and advantages thereof appear more clearly on reading the following description made by way of non-limiting example and with reference to the accompanying drawings, in which.

MORE DETAILED DESCRIPTION

Figure 1:
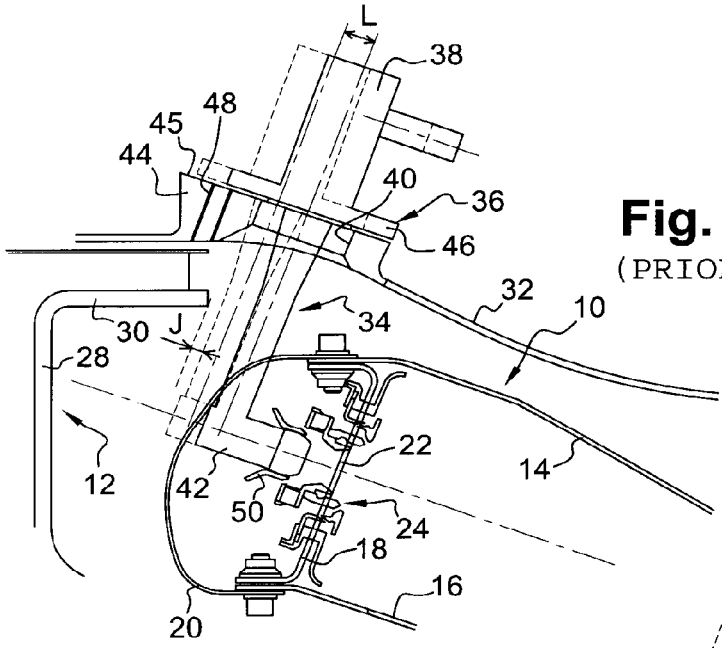
Fig. 1 (PRIOR ART)
FIG. 1 is a fragmentary diagrammatic half-view in axial section of a combustion chamber of a turbomachine fitted with a prior art fuel injector.

FIG. 1 shows an annular combustion chamber 10 of a turbomachine such as an airplane turboprop or turbojet, the chamber 10 being arranged at the outlet from a diffuser 12, which is in turn situated at the outlet from an axial-centrifugal compressor that is not shown.

The chamber 10 has an outer wall 14 forming a body of revolution and an inner wall 16 also forming a body of revolution, which walls are connected together at an upstream end by an annular chamber end wall 18.

An annular fairing 20 is fastened to the upstream ends of the chamber chambers 14, 16, and 18, and it includes air-passing orifices in alignment with openings 22 in the chamber end wall 18, each having a mixer 24 mounted therein to mix the air coming from the diffuser 12 with fuel delivered by fuel injectors 34.

The diffuser 12 has a substantially radial annular portion 28 with its inner periphery connected to the outlet from the compressor and with its outer periphery connected to the upstream end of a cylindrical portion 30. The downstream end of the cylindrical portion 30 forms the air outlet from the diffuser and is situated radially outside the openings 22 in the chamber end wall 18 in the example shown.

The fuel injectors 34 are fastened to an outer casing 32 that surrounds the diffuser 12 and the combustion chamber 10, and they are regularly distributed around the longitudinal axis of the chamber. Each injector 34 is substantially L-shaped and is mounted and secured to the outer casing 32 by suitable means 36.

Each injector 34 has a rectilinear arm 38 that extends substantially radially through a radial orifice 40 of the casing 32 and that is connected at its radially inner end to an injection head 42 oriented substantially axially downstream, the arm 38 and the head 42 of the injector being substantially mutually perpendicular. The radially-outer end of the arm 38 of the injector, situated outside the outer casing 32, is connected to fuel feeder means that are not shown.

The assembly orifice 40 for the injector 34 is formed in an outwardly-directed boss 44 projecting from the casing 32, this boss presenting a plane face 45 at its radially-outer end. The arm 38 of the injector has an outer collar 46 that is pressed and clamped against the plane face 45 of the boss 44 by screws that pass through orifices in the collar and that are screwed into corresponding tapped orifices 48 in the boss.

Figure 2:
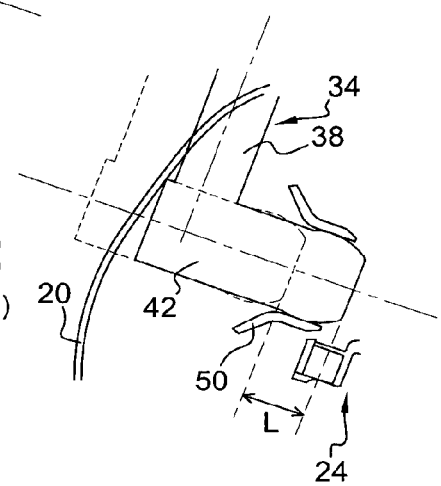
Fig. 2 (PRIOR ART)
FIG. 2 shows a fragment of FIG. 1 on a larger scale.

When the injector 34 is in its mounted position, as shown in continuous lines in FIGS. 1 and 2, the downstream end portion of its head 42 is engaged axially in a cup 50 of the mixer 24, and the collar 46 of its arm bears against the outer plane face 45 of the boss 44 of the casing.

In the prior art technique, the injector 34 is dismantled as follows: the operator moves the injector in translation in an upstream direction from outside the casing 32, in a direction that is parallel to the axis of the injection head 42 so as to disengage said head from the cup 50 of the mixer. The injector 34 can be moved from its furthest-forward mounted position (in continuous lines) to a further-back position (in discontinuous lines) through a distance L of 9.17 mm in one prior art embodiment.

In the example shown, the outer face 45 of the boss 44 is parallel to the axis of the head 42 of the injector and it suffices to cause the collar 46 of the injector to slide upstream on the plane face 45 of the boss in order to disengage the head 42 from the cup 50 of the mixer.

Figure 12:
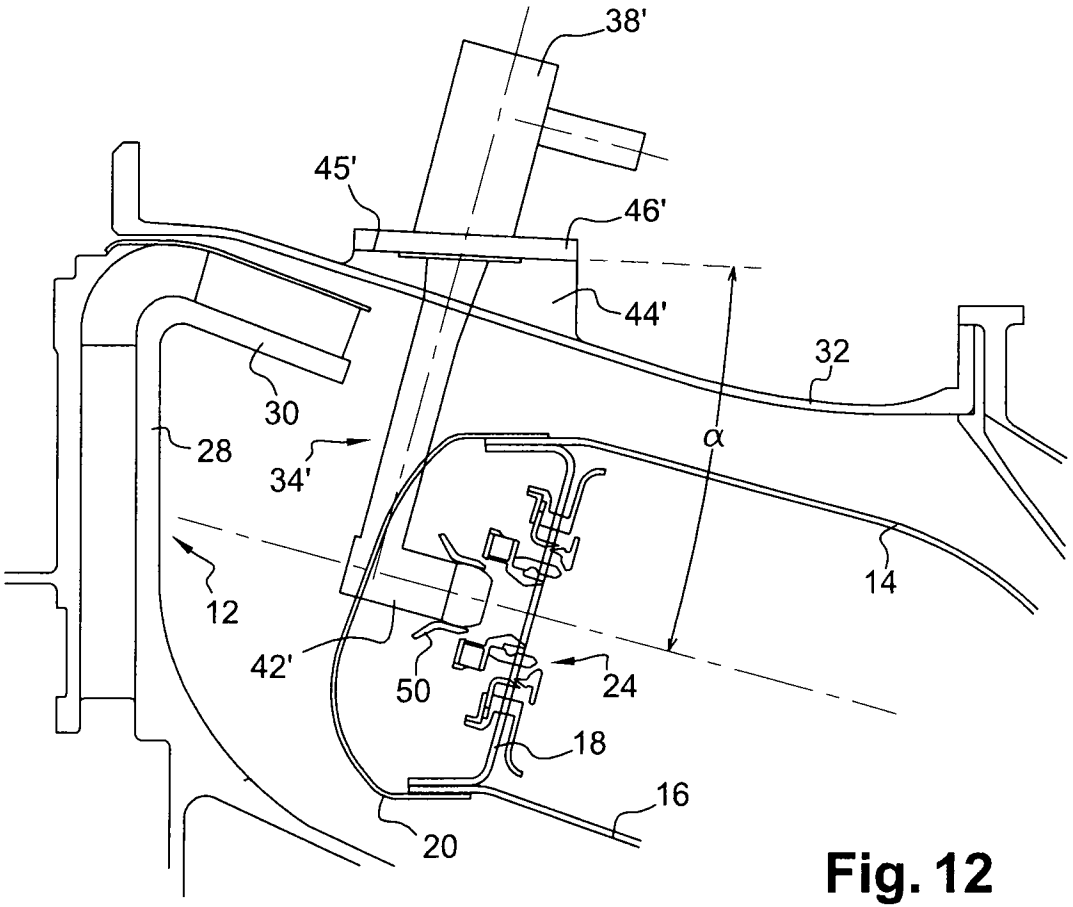
FIG. 12 is a fragmentary diagrammatic half-view in axial section of another turbomachine combustion chamber fitted with a fuel injector.

In a variant, and as shown in FIG. 12, the outer face 45' of the boss 44' of the casing forms an angle a greater than 0° relative to the axis of the head 42' of the injector. The collar 46' of the injector bears against the outer face 45' of the boss.

Once the injector is in its furthest-back position, the operator can withdraw it from the chamber by pulling its radially outer end outwards.

In order to avoid the downstream end of the diffuser 12 impeding dismantling and removal of the injector 34, it is necessary to provide clearance J (e.g. 3.8 mm) between the end of the diffuser and the injector when it is in its furthest-back position from the end wall of the combustion chamber.

Figure 3:
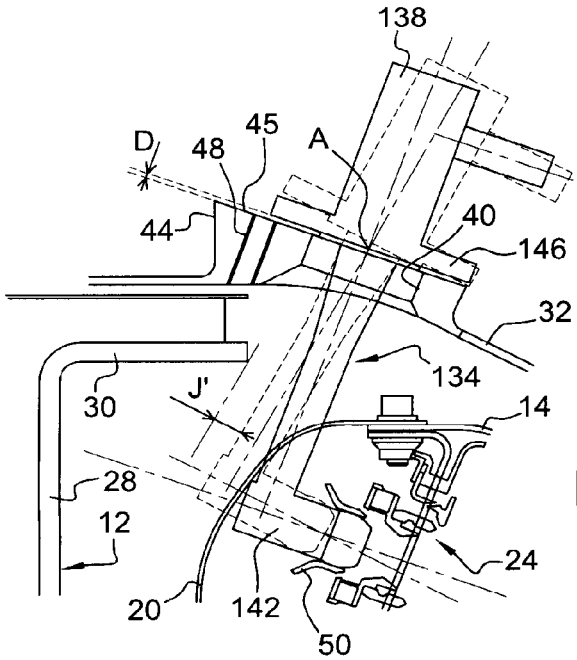
FIG. 3 is a fragmentary diagrammatic half-view in axial section of a turbomachine combustion chamber fitted with a fuel injector of the invention.

The invention enables the movements of mounting and dismantling the injector 134 to be modified, the head 142 of the injector now being disengaged from the mixer 24 by causing the radially-outer end of the injector 134 to tilt or pivot downstream about a transverse axis A passing substantially via the collar 146 of the injector (FIG. 3). For this purpose, when the injector 134 is in the mounted position shown in continuous lines in FIG. 3, the downstream end portion of its head 142 is engaged in the cup 50 of the mixer 24 and the collar 146 of its arm 138 is spaced apart from the plane face 45 of the boss 44 of the casing by a sufficient distance D. This is made possible by reducing the height or radial dimension of the boss or by increasing the length of the injector arm by the above-mentioned distance D.

The spacing between the collar 146 of the injector and the boss 44 of the casing makes it possible, while dismantling the injector, to give the injector a degree of freedom to move in rotation about the axis A. The injector 134 is movable in rotation about said axis A from the above-mentioned mounted position to a further-back position for its injection head 142, shown in discontinuous lines in FIG. 3, where it is disengaged from the mixer 24.

In this further-back position, the resulting clearance J' between the downstream end of the diffuser 12 and the injector is 7.4 mm in the above example. It is thus possible to reduce the axial size of the engine by about 3.6 mm so as to conserve clearance of only 3.8 mm between those elements, as described above.

In the invention, an additional part is used for mounting and fastening the injector 134 on the casing 32, this part being a removable annular spacer surrounding the arm 138 of the injector and interposed between the collar 146 of the injector and the boss 44 of the casing.

Figure 4:
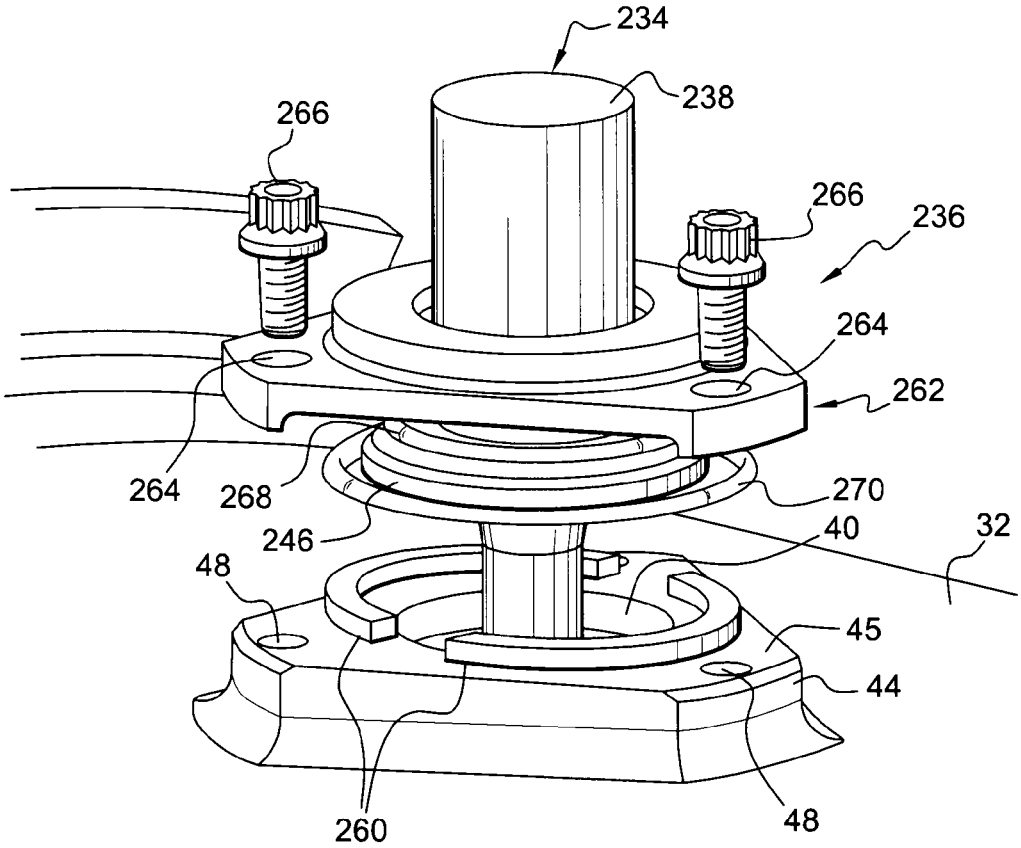
FIG. 4 is a fragmentary diagrammatic view in exploded perspective of an injector of the invention mounted on an outer casing of a combustion chamber.
Figure 5:
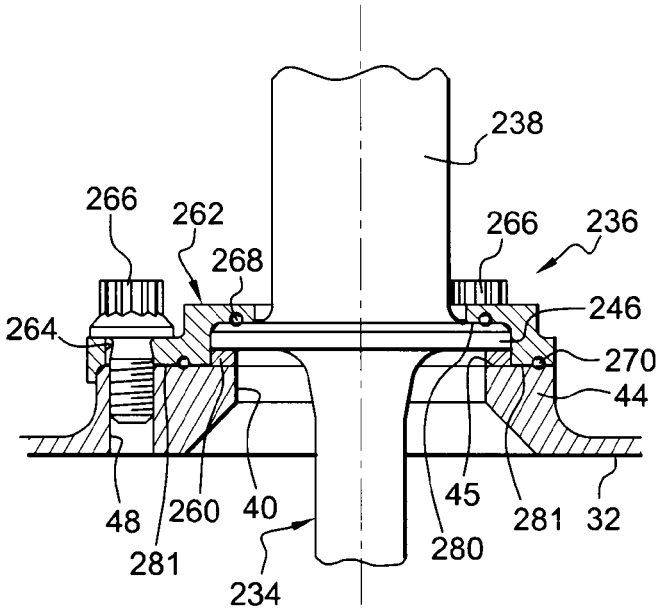
FIG. 5 is a diagrammatic axial section view of the injector and the casing of FIG. 4.

In the embodiment shown in FIGS. 4 and 5, the annular spacer 260 is sectorized to form two spacer sectors having the same angular extent, placed end to end around the arms 238 of the injector and interposed between the collar 246 of said arm and the outer face 45 of the boss of the casing.

The spacer 260 presents a section of rectangular shape and the circumferential ends of its sectors are cut at right angles. These circumferential ends are designed to bear against each other in the mounted position.

The outside diameter of the spacer 260 is substantially equal to that of the collar 246 of the injector, and for example lies in the range about 30 mm to about 40 mm. Its thickness is determined as a function of the clearance needed to allow the injector 234 to pivot (for example it is about 2 mm or 3 mm). For example it is made of a metal material.

In this example the collar 246 of the injector is annular in shape and it does not have any orifices for passing screws. The collar 246 is held clamped against the spacer 260 by an annular clamp 262 fitted thereon. The clamp 262 surrounds the top end of the arm 238 of the injector and is designed to bear via one face 280 of its inner periphery against a face of the collar 246, facing away from the spacer. The outer periphery of the clamp 262 has a face 281 facing the outer face 45 of the boss, and it includes orifices 264 for passing fastener screws 266 that are designed to be screwed into the tapped orifices 48 of the boss of the casing.

Clearance is provided between the face 281 of the outer coupling of the clamp 262 and the face 45 of the boss 44 so as to enable the collar 246 and the spacer 260 to be clamped between the clamp 262 and the casing 32.

Annular sealing rings 268 and 270 are clamped firstly between the face 280 of the inner periphery of the clamp 262 and the collar 246 of the injector, and secondly between the face 281 of the outer periphery of the clamp and the plane face 45 of the boss. These gaskets 268 and 270 may be housed in annular grooves in the camp 262, as in the example shown. The gaskets 268 and 270 may be 0-rings or they may be C-section gaskets.

The injector 234 may be dismantled as follows. The operator unscrews the screws 266 and removes these screws together with the clamps 262, acting from outside the casing 32. Thereafter the annular spacer 260 is removed by spacing its sectors apart from each other in substantially radial directions relative to the axis of the arm 234 of the injector. This step may be preceded by moving the injector 234 outwards a little (e.g. through about 2 mm) in order to facilitate access and withdraw the sectors of the spacer. The injector may then be moved by being pivoted about a transverse axis in order to disengage the head of the injector from the mixer, as described above with reference to FIG. 3. The injector 234 is mounted by performing the above-described steps in the opposite order.

Figure 6:
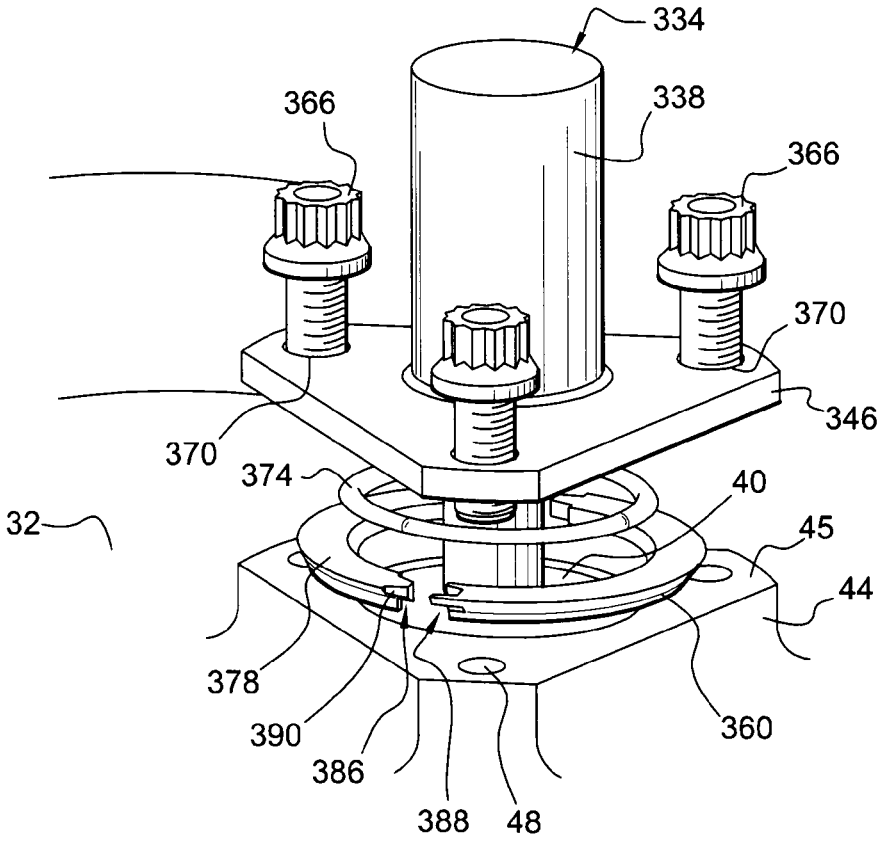
FIG. 6 is a fragmentary diagrammatic view in exploded perspective of a variant embodiment of the injector of the invention mounted on a combustion chamber casing.
Figure 7:
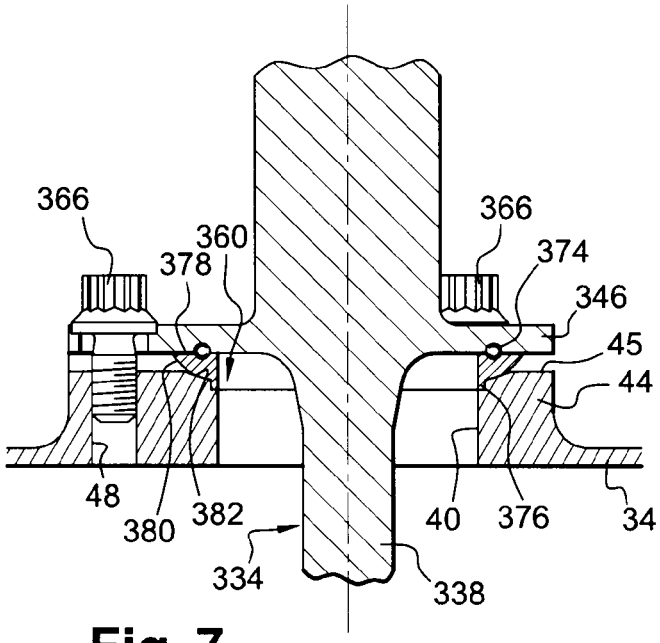
FIG. 7 is a diagrammatic axial section view of the injector and the casing of FIG. 6.
Figure 8:
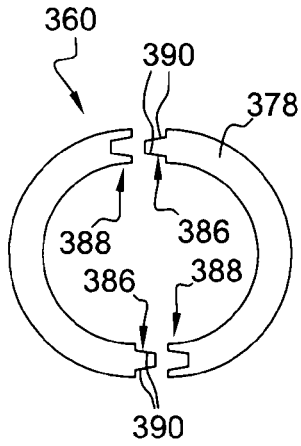
FIG. 8 is a diagrammatic plan view of the removable annular spacer of the injector of FIGS. 6 and 7.

The variant embodiment shown in FIGS. 6 to 8 differs from the embodiment described above in particular in that the collar 346 of the injector is fastened directly to the boss 44 of the casing by screws 366 that pass through orifices 370 in the collar and that are screwed into tapped orifices 48 in the boss.

The spacer 360 is made up of two sectors placed end to end. Here the spacer is substantially triangular in section and has a cylindrical rim 376 at its end situated beside the casing, which rim is engaged in a cylindrical bore of complementary shape in the boss 44 so as to center the spacer 360 relative to the orifice 40 in the casing.

The opposite end of the spacer 360 presents a plane annular surface 378 against which the collar 346 of the injector bears, an annular sealing gasket 374 being clamped between the collar and said surface of the spacer. The outer periphery of this surface 378 is connected to the annular rim 376 by a spherical annular surface 380 for bearing against a frusto-conical bearing surface 382 of the boss, surrounding the orifice 40, thereby providing the assembly with sealing when the screws 366 are tightened.

Each spacer sector 360 includes a male or projecting portion 386 at one of its circumferential ends, and at its other circumferential end it includes a female or recessed portion 388 of complementary shape, such that these circumferential end portions engage in the corresponding circumferential end portions of the other spacer sector.

In the example shown, the projecting portion of each sector is substantially pyramid-shaped and presents two opposite faces 390 that are inclined relative to each other and that are designed to bear against the corresponding inclined faces of the recessed portion of the other sector.

The injector 334 is dismantled in similar manner to that described above.

Figure 9:
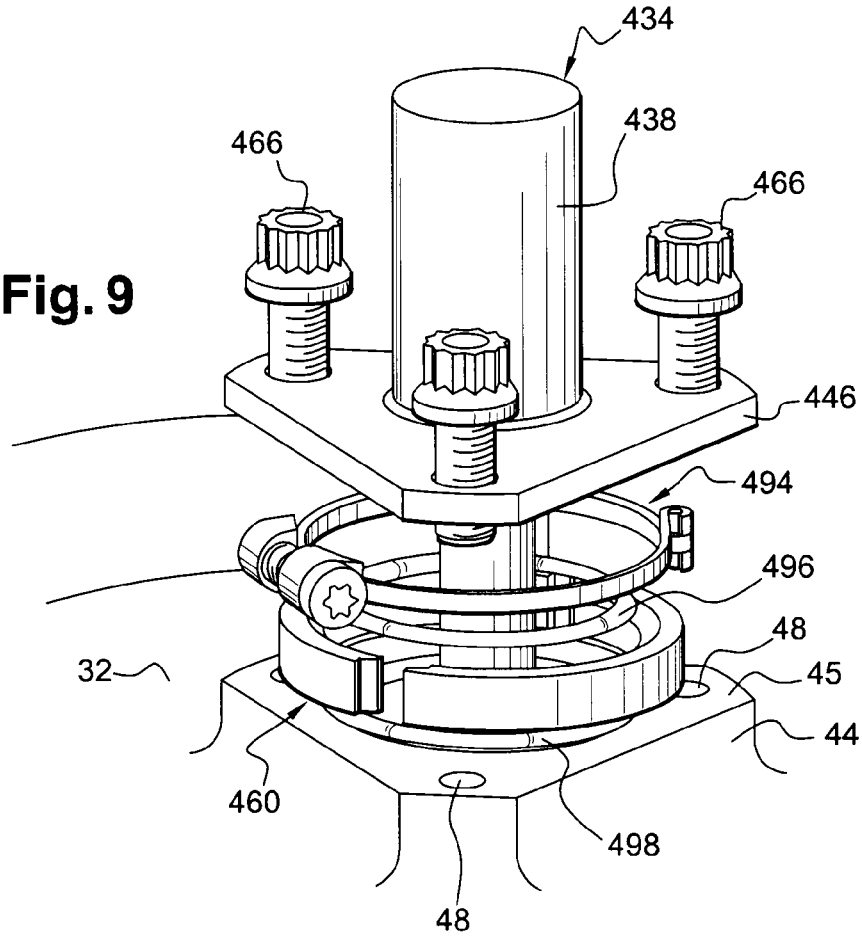
FIG. 9 is a fragmentary diagrammatic view in exploded perspective showing another variant injector of the invention mounted on a combustion chamber casing.
Figure 10:
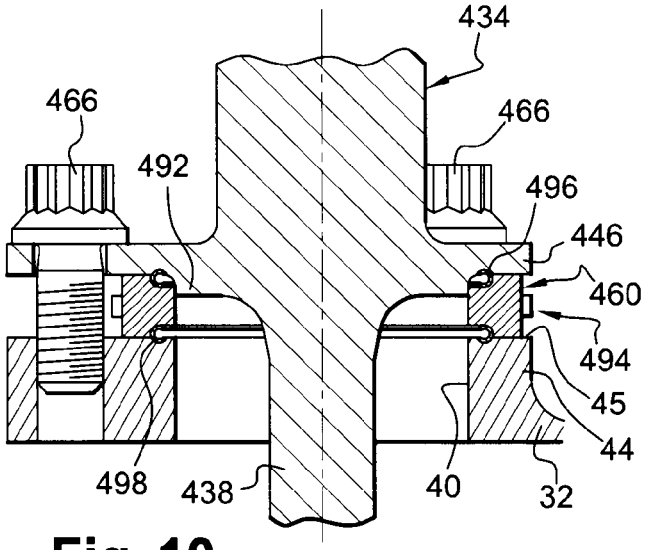
FIG. 10 is a diagrammatic axial section view of the injector and the casing of FIG. 9.
Figure 11:
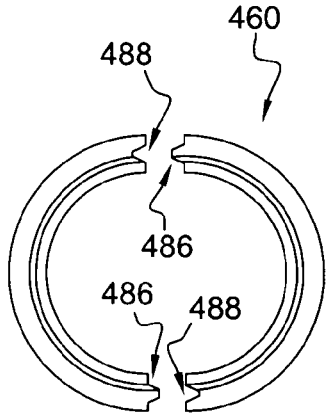
FIG. 11 is a diagrammatic plan view of the removable annular spacer of the injector of FIGS. 9 and 10.

In the variant embodiment shown in FIGS. 9 to 11, the injector 434 is substantially identical to above-described injector 334 and it is fastened on the boss of the casing by screws 466 passing through orifices in its collar 446. The collar 446 includes, beside the casing, a cylindrical portion 492 around which the spacer 460 extends. This portion 492 enables the spacer to be centered relative to the injector.

This spacer 460 has a section that is substantially T-shaped and it is made up of two sectors that are placed end to end and that are held together by the clamping collar 494 mounted around the spacer 460.

Beside the collar 446 of the injector, the spacer 460 presents a first annular groove housing an annular sealing gasket 496 that is designed to be clamped between the spacer and the collar, and beside the casing 32 it has a second annular groove housing another annular sealing gasket 498 that is designed to be clamped between the spacer and the plane face 45 of the boss.

At their circumferential ends, the sectors of the spacer 460 likewise have solid portions 486 and recessed portions 488 of the above-described type.

The clamping collar 494 extends around the spacer 460 between the collar 446 of the injector and the boss 44 of the casing, and it is fitted with screw-and-nut type means that are used to vary the inside diameter of the collar and thus the clamping of the ring sectors.

This injector 434 is dismantled in a manner similar to that described with reference to FIGS. 4 and 5, with the exception of the fact that there is an additional step of dismantling the clamping collar 494 prior to withdrawing the spacer 460.

In a variant, the spacer could be made of some number of sectors greater than two.

The fuel injector of the combustion chamber of the invention is not necessarily made up of an arm and a head that are rectilinear and mutually perpendicular, but in a variant could include at least one portion that is circularly arcuate.

What is claimed is:

1. A turbomachine combustion chamber comprising:

at least one substantially L-shaped fuel injector comprising an arm with a first end connected to an injection head and a second end designed to be connected to fuel feed means; and means for mounting and fastening the injector in an orifice of a casing of the chamber, said means for mounting and fastening including an outer collar carried by the arm of the injector, and an annular spacer surrounding the arm of the injector and interposed between the collar of said arm and the casing, wherein said spacer is sectorized and removed during dismantling of the means for fastening the injector on the casing, removal of the spacer increasing a clearance between the outer collar and the casing which allows the collar to pivot relative to the casing and the injector to pivot in the orifice in the casing, the outer collar being sized larger than the annular spacer in a direction substantially transverse to an axis of the arm.

2. The chamber according to claim 1, wherein the spacer comprises at least two sectors placed end to end.

3. The chamber according to claim 2, wherein each spacer sector includes, at a first circumferential end, a projecting portion designed to engage in a recessed portion of complementary shape provided at a second circumferential end of another spacer sector.

4. The chamber according to claim 2, wherein the means for mounting and fastening the injector comprise a clamping collar surrounding the spacer sectors in order to hold the spacer sectors together.

5. The chamber according to claim 1, wherein the means for mounting and fastening the injector include at least one annular sealing gasket designed to be interposed between at least one of the collar of the arm and the spacer, said collar and the casing, or the spacer and the casing.

6. The chamber according to claim 1, wherein the spacer is of substantially rectangular, triangular, or T-shaped section.

7. The chamber according to claim 1, wherein the spacer includes a spherical or frustoconical annular surface for bearing against the casing of the chamber.

8. The chamber according to claim 1, wherein the collar includes screw-fastening orifices to enable the injector to be fastened to the chamber casing and to enable the spacer to be clamped between the collar of the arm and the casing.

9. The chamber according to claim 1, wherein the means for mounting and fastening the injector comprise a removable annular clamp surrounding the arm of the injector and including screw-passing orifices for fastening the injector on the casing of the chamber and for clamping the collar of the arm and the spacer between the clamp and the casing.

10. The chamber according to claim 9, wherein the means for mounting and fastening the injector include at least one annular sealing gasket interposed between at least one of the clamp and the collar or the clamp and the casing.

11. The chamber according to claim 1, further comprising an annular casing having a plurality of substantially radial orifices, each orifice having a fuel injector mounted therein, and being formed in an outer boss of the casing, and the spacer being interposed between the collar of the injector arm and said boss.

12. The chamber according to claim 11, wherein the spacer is sandwiched between an outer face of said boss and an inner face of the collar of the injector arm.

13. The chamber according to claim 1, further comprising:

an annular fairing fastened to an outer wall of the combustion chamber, an inner wall of the combustion chamber, and a chamber end wall connecting the outer and inner walls of the combustion chamber, the fairing including air-passing orifices in alignment with openings in the chamber end wall, each air-passing orifice having a mixer mounted therein, and the injection head being axially engaged in a cup of the mixer, wherein the combustion chamber is arranged at an air outlet of a diffuser including a substantially radial annular portion and a cylindrical portion, an upstream end of the cylindrical portion being connected to an outer periphery of the substantially radial annular portion and a downstream end of the cylindrical portion presenting the air outlet and being situated radially outside the openings in the chamber end wall.

14. The chamber according to claim 1, wherein the second end of the fuel injector is situated outside the casing of the chamber.

15. A method of mounting and/or dismantling a fuel injector in a combustion chamber according to claim 1, the method comprising:

removing the spacer; and moving the injector to pivot about a transverse axis so that a head of the injector engages/disengages in/from a mixer of the chamber.

* * * * *

UNITED STATES PATENT AND TRADEMARK OFFICE

CERTIFICATE OF CORRECTION

PATENT NO. : 8,516,830 B2
APPLICATION NO. : 12/544423
DATED : August 27, 2013
INVENTOR(S) : Sylvain Duval et al.

It is certified that error appears in the above-identified patent and that said Letters Patent is hereby corrected as shown below:

In the Specification

Column 5, Line 5, change “forms an angle a” to --forms an angle α--; and

Column 6, Line 18, change “may be 0-rings” to --may be O-rings--.

Signed and Sealed this
Fourth Day of February, 2014

Michelle K. Lee

Michelle K. Lee
*Deputy Director of the United States Patent and Trademark Office*